United States Patent [19]

Arens

[11] Patent Number: 4,877,253

[45] Date of Patent: Oct. 31, 1989

[54] REUSABLE BINGO CARD

[75] Inventor: Robert P. Arens, North St. Paul, Minn.

[73] Assignee: Minnesota Mining and Manufacturing Company, St. Paul, Minn.

[21] Appl. No.: 12,547

[22] Filed: Feb. 6, 1987

[51] Int. Cl.[4] ..... A63F 3/06

[52] U.S. Cl. ..... 273/240; 273/269; 428/315.5

[58] Field of Search ..... 283/901; 428/315.5; 273/269, 378, 240

[56] References Cited

U.S. PATENT DOCUMENTS

| | | | |
|---|---|---|---|
| 2,299,991 | 10/1942 | Kallock | 346/1.1 |
| 3,031,328 | 4/1962 | Larson | 427/394 |
| 3,247,006 | 4/1966 | Hoge et al. | 434/317.9 |
| 3,454,344 | 7/1969 | Ryan et al. | 273/378 |
| 3,508,344 | 4/1970 | Thomas | 434/327 |
| 3,826,499 | 7/1974 | Lenkoff | 273/269 |
| 4,165,878 | 8/1979 | Frain | 273/240 |
| 4,299,880 | 11/1981 | Arens | 428/315.5 |
| 4,374,889 | 2/1983 | Arens | 428/207 |
| 4,418,098 | 11/1983 | Maistrovich | 427/161 |

FOREIGN PATENT DOCUMENTS 50-5097 2/1975 Japan .

*Primary Examiner*—Edward M. Coven
*Assistant Examiner*—Benjamin Layno
*Attorney, Agent, or Firm*—Donald M. Sell; Walter N. Kirn; Richard E. Brink

[57] ABSTRACT

A reusable bingo card comprising an exposed microporous layer having bingo numbers permanently imprinted thereon, and a liquid impervious support sheet bonded to the exposed layer. The support sheet is substantially darker than the background area of the exposed layer. To mark a number on the card a colorless volatile liquid is applied to the exposed layer making the applied area transparent and exposing the support sheet below producing a contrasting indicia that is darker than the background area but lighter than the numbers. Evaporation of the marking liquid restores the bingo card to its original appearance for reuse.

9 Claims, 1 Drawing Sheet

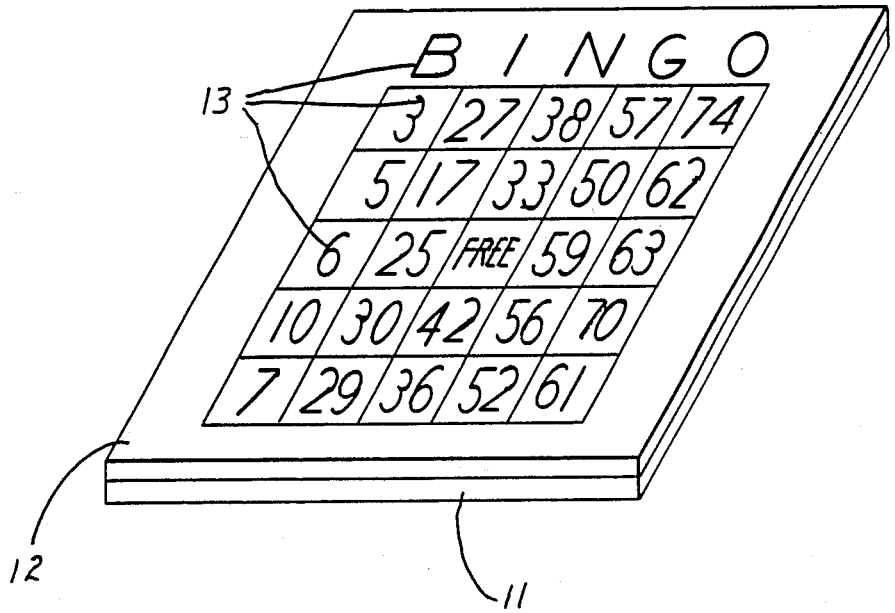
B I N G O
3 27 38 57 74
5 17 33 50 62
6 25 FREE 59 63
10 30 42 56 70
7 29 36 52 61
13
12
11

REUSABLE BINGO CARD

BACKGROUND OF THE INVENTION

For many years one of the most popular games of chance has been Bingo, and commercial Bingo parlors flourish throughout the U.S. and Canada. In its simplest form, and as originally played under the name "Lotto," each participant is provided with a card printed with a square crosshatched into individual smaller squares, each of the smaller squares (with the possible exception of the center one) being permanently imprinted with a number of one or two digits. The operator of the game then randomly selects numbered discs from a container and calls out the number. Most modern Bingo parlors employ numbered balls or even computer-generated numbers. In any event, each player having a called number then places on the appropriate square a disc, marker, kernel of corn, etc., the game ending when one player has covered five squares in a line. (As a point of interest "bingo" is thought to be a corruption of "beano," referring to the use of beans as markers.) Although such cards can be reused in subsequent games, the markers tend to fall on the floor, where they are lost or stepped on, sometimes to the injury of the person doing so, and in any event contribute to the general clutter.

In recent years, Bingo has become increasingly more sophisticated, involving, e.g., including the provision of cards that no longer necessarily contain the traditional 25 small squares. For example, some of the modified Bingo cards may contain a rectangle subdivided into 25 or more smaller rectangles, of which at least 5 (but not necessarily all) are imprinted with one- or two-digit numbers. With such cards, the game winner is the first player to have five numbers called (whether or not the rectangles containing the numbers are in a line).

It is fairly common practice in Bingo parlors today to provide players with a sheet of newsprint that has been imprinted with perhaps six individual Bingo grids. Players are provided with daubers containing colored water-soluble ink, which they then apply to numbers that are announced by the game operator. Although this system is simple, convenient, and perhaps twice as fast as placing markers on the squares, the hands and clothing of the players, as well as the tables upon which they play, often become soiled with the colored ink. Further, although newsprint is comparatively inexpensive, the amount consumed in a session of Bingo is astonishingly high, and, since the sheets can be used only once, cost is a significant factor in reducing the game operator's profit.

Recognizing the expense involved in providing great quantities of newsprint sheets, attempts have been made to develop reusable equipment; thus, for example, U.S. Pat. No. 4,165,878 discloses a pocketlike game board imprinted on one side with the traditional Bingo grid of 25 squares, each individual square (other than the center one) bearing a number and having an opening. Sheets of paper are inserted into the pocket and placed at various locations, each location providing for a single game of Bingo as the player places a mark on the paper through the opening adjacent each called number. Such a device tends to be expensive, inconvenient for the average player to use, and limited to a single set of numbers.

Other attempts to make reusable Bingo cards have involved applying a glossy surface to the front of the card and placing marks with grease pencils. Although each card can then be used several times, it is inconvenient to clean, and, as in the case of the dye dauber, players often find their hands and clothing smudged.

BRIEF SUMMARY

The present invention provides a novel repeatedly reusable Bingo card that not only retains the benefits but also avoids the problems inherent in previous equipment. The invention also provides a novel way of playing Bingo, differing significantly from prior approaches. There are no individual discs or similar markers to be lost, dislodged, or stepped on, and there is no dye or grease pencil to stain or smudge hands, clothing, or tables. The cards are durable, neat and considerably more attractive than sheets made out of newsprint, and they can be bound together in a convenient booklet. The invention relies on technology that has been known for decades but apparently never before recognized as having utility in playing the game of Bingo.

In accordance with the invention, a player utilizes a preprinted form and applies indicia to selected portions thereof, the improvement residing in the fact that (1) the form is printed on the exposed face of sheet material having an exposed layer that is microporous and (2) the indicia are generated by applying to selected portions of the exposed face a substantially colorless volatile marking liquid that imparts a localized visual contrast in which the indicia are darker than the surrounding area and remain visible for a predetermined period of time. Evaporation of the volatile liquid restores the form to its original appearance and thus enables it to be repeatedly reused.

In its simplest form, a Bingo card comprises a sheet material having an exposed microporous layer that is permanently imprinted with at least one rectangle crosshatched into individual smaller rectangles, at least five of the smaller rectangles being permanently imprinted with a number of one or two digits. The sheet material is characterized by temporarily presenting indicia that have a Hunter L value on the order of 30–55 and visually contrasts with the remainder of the microporous layer when locally contacted with an appropriate colorless volatile liquid.

Several U.S. patents (e.g., U.S. Pat. Nos. 2,299,991, 3,031,328 and 3,508,344) disclose composite sheet material in which a light-colored opaque blushed lacquer layer is coated over a base sheet that is either dark-colored or imprinted with dark-colored indicia. The opacity and light color of the blushed lacquer coating are due to the inclusion of numerous microvoids; the local application of (1) heat or pressure (either of which irreversibly collapses the microvoids) or (2) a non-solvent liquid having substantially the same refractive index as the lacquer (which fills the microvoids), causes the coating to become selectively transparent and the underlying dark backing to become visible. Subsequent evaporation of the liquid restores the original uniform appearance of the microvoid layer.

U.S. Pat. No. 2,854,350 describes structures which are functionally similar to those just described, except that the blushed lacquer coatings are replaced by a microporous layer of finely divided calcium carbonate held in pseudo-sintered juxtaposition in an organic binder. Transparency is imparted by locally applying pressure or treating selected areas with a wax, oil or grease having a refractive index similar to that of the calcium carbonate and the binder; see U.S. Pat. No.

2,854,350. Other pigments may similarly be incorporated in a microporous highly plasticized resin binder; see, e.g., U.S. Pat. No. 3,247,006.

Other patents teaching microporous layers suitable for practicing the invention are found in Japanese Pat. No. 50-5097. In some circumstances the microvoid-containing layer can be as simple as a piece of paper.

Generally, however, it is highly preferred to have microvoid-containing sheet material that is not only capable of displaying indicia when contacted with appropriate colorless volatilizing liquid but is also sufficiently durable that it cannot readily be transparentized by the application of heat or pressure. In such circumstances, a microvoid-containing layer of the type described in U.S. Pat. No. 4,299,880 (the disclosure of which is incorporated herein by reference), owned by applicant's assignee, is preferred. This patent discloses a structure in which the microvoid-containing layer consists essentially of particles held in pseudo-sintered juxtaposition by a thermoset binder and has a cohesion value of at least 400 grams force*.

* The cohesion value is determined by knife-coating a dispersion of a putative composition on a cleaned gray cold rolled steel panel, drying and curing as appropriate for the composition, to provide a coating 50–60 micrometers thick. Using a "Balance Beam Scrape-Adhesion and Mar Tester", sold by Gardner Laboratories, Inc., Bethesda, Md., a sapphire-tipped stylus is lowered into contact with the test panel and held in fixed position while a ball bearing-supported platform moves the panel. The minimum grams-force required to form a 50-micrometer deep scratch in the coating in a single pass is determined at a magnification of 40× and reported as cohesion value.

Bingo cards particularly suitable for practicing the invention are obtained by incorporating in the microvoid-containing layer an organic polymer that jellifies in the presence of the colorless marking liquid so as to limit both lateral and vertical migration; see, e.g., U.S. Pat. No. 4,418,098 (the disclosure of which is incorporated herein by reference), also owned by applicant's assignee.

Because persons playing Bingo often simultaneously eat greasy foods or drink liquids that might soil the Bingo card, it may also be desirable to treat the inventive microvoid layer with fluorochemicals that are oleophobic and preferably also hydrophobic. Surface contamination, which might cause permanent transparentization and prevent re-use, is readily removed by placing the face side of the sheet material in contact with an absorbent material that does not have the fluorochemical treatment. If desired, the Bingo card may be provided with a microvoid-containing layer on each surface, only one surface of which is imprinted with the Bingo grid and numbers, that surface also being treated with the fluorochemical. The other surface, which is neither imprinted with the Bingo grid nor treated with fluorochemical, may then be placed in contact with the contaminated fluorochemical-treated surface of another card, from which it will readily absorb oil and other contamination. Products of this general type are described in U.S. Pat. No. 4,374,889 (the disclosure of which is also incorporated herein by reference), assigned to applicant's assignee.

BRIEF DESCRIPTION OF THE DRAWING

As an aid to understanding the invention, attention is directed to the accompanying drawing, which depicts a reusable Bingo card made in accordance with the invention. In the interest of clarity, the thickness has been greatly exaggerated.

In the drawing, liquid-impervious support sheet 11 is providing with opaque microporous layer 12, which in turn is imprinted with indicia 13. Support sheet 11 is lighter in color than indicia 13 but darker in color than the background are of microporous layer 12 that surrounds indicia 13. Upon the application of a void-filling liquid to it surface, layer 12 becomes transparent, rendering the dark surface of support sheet 11 visible without obscuring indicia 13.

PRESENTINGLY PREFERRED EMBODIMENTS

Understanding of the invention will be further enhanced by referring to the following illustrative but nonlimitative examples, in which all parts, percentages and ratios are by weight unless otherwise noted.

EXAMPLE 1

A support sheet was prepared by extruding a thin film of high density polyethylene into the nip between two 89-micrometer blue kraft paper sheets, each weighing 0.4 g/m$^2$ and calendering the resultant laminate so that its ultimate thickness was 7 mils and the total weight was about 65 g/m$^2$.

Using a curtain coater, to one side of the laminate described in the preceding paragraph was applied a 70% solids coating of 0.5- to 15-micrometer crushed marble ("Microwhite 25", available from Sylacauga Calcium Products Company) in a binder consisting essentially of 4.2 parts hydroxy-functional acrylic urethane ("G-cure 868-PWF-60", available from Henkel) and 1.0 part hexamethylene diisocyanate ("Desmodur N-75", available from Mobay). The solvent employed was 5:5:1 toluene:methylisobutylketone:diisobutylketone. The coating was heated 20 seconds at 120° C. in a circulating air oven to evaporate the solvent and initiate crosslinking, the dried coating being about 12.7 micrometers thick, microporous, and containing 85% marble by volume. The opposite side of the laminate was then coated with the same composition and dried in the same manner, the resultant sheet material being about 200 micrometers thick. The first side of the sheet material was then coated with a 3% ethanol solution of a fluorochemical chrome complex and the solvent evaporated to leave a stain-resistant surface. The sheet material was thereafter die-cut into 28-cm×42-cm sheets, the first sides of which were then pattern-printed with a 100% oxidizable lithographic ink in any of several pastel colors, defining twelve separate Bingo grids, the individual squares of each grid remaining unprinted. In a second operation the word "Bingo" was imprinted in black above each grid and one- or two-digit numbers imprinted on all but the center square of each grid, again using a 100% oxidizable lithographic ink. The sheets were then bound into a book.

A cylindrical container of the type conventionally used for marking pens was filled with transparent volatile marking fluid, viz., a mixture of $C_{11}$–$C_{15}$ isoalkanes and the top closed with a cylindrical block of felted fibers. When the exposed tip of the felted block was placed in contact with the normally white surface of the microporous coating, the isoalkanes penetrated the surface and, since they had substantially the same refractive index as the coating, rendered it transparent, thereby making the blue underlying support layer visible. The lithographic ink and the marking fluid were, of course, selected so that the ink did not dissolve or bleed. At 20° C. , the resultant indicia remained visible for approximately 30 minutes on an exposed page, well beyond the time required for one Bingo game to be completed. Since evaporation is inhibited when a book is closed, Bingo hall operators may find it desirable to collect books at the end of an event and hang them on racks in a circulating air drying cabinet (e.g., 65° C. for 2 hours) to accelerate evaporation and insure that the book will be ready for use at the next event. The product of this Example 1 could be used at least 100 times before its appearance was considered unsatisfactory.

In the preceding example the blue kraft paper serves two purposes, (1) to provide a contrasting color when the microporous layer is locally transparentized and (2) to absorb any excess transparentizing fluid that may have been applied inadvertently. The polyethylene prevents transmission of the fluid to underlying cards. If desired, the three-ply support layer construction can be replaced with a single layer of colored polymeric film or a nonporous black greaseproof paper.

EXAMPLE 2

Sheet material substantially similar to that of Example 1 was prepared, the soil-retarding fluorochemical being omitted and Bingo grids imprinted on both sides of the sheet material. The resultant product could be used at least fifty times before it became too soiled to be considered acceptable in a first class Bingo game. In this construction, the polyethylene film prevented transmission of marking liquid from the microporous layer on one side to the microporous layer on the other side, permitting the second side to be used immediately after the first side had been used. It will be apparent that treatment of both sides of the sheet material with soil-retarding fluorochemical would prolong its useful life, especially if absorbent sheet material were placed in contact with the soiled surface from time to time. This can be readily accomplished by interleaving the Bingo cards with absorbent paper.

EXAMPLE 3

One surface of an 89-micrometer sheet of white bond paper was coated with a 12% solids aqueous basic solution (pH 9) of a base-soluble acrylic resin ("Carboset" 526) in which was dispersed a finely divided carbon black (Cabot "Mogul L") and the water evaporated to leave coating weighing about 10.7 g/m$^2$ and containing 14% carbon black by volume. The uncoated surface of the paper was first imprinted with a pastel background color defining a Bingo grid and then with numbers as in Example 1. Although less durable than the sheet material of Examples 1 and 2, it was less expensive and could be reused several times. The cost of the product can be reduced still further by substituting newsprint for the bond paper.

EXAMPLE 4

To prepare an extremely inexpensive sheet material embodying the invention, a Bingo grid is imprinted on 50-micrometer goldenrod-colored bond paper, the color being attributed to stilbene pigment, which is water-insoluble but functions as an acid-base indicator, changing to orange-red when contacted with dilute bases. Indicia may be temporarily applied to this paper by locally contacting it with a marking instrument containing a 0.1% aqueous solution of ammonia or some other volatile base. Other acid-base indicators, e.g., of the type employed in pH paper, can be substituted for the stilbene to obtain comparable color changes when contacted with dilute acids or bases. Although very inexpensive and capable of re-use, products made in accordance with this example tend to cockle when subjected to the aqueous marking liquid.

As previously indicated, it may be desirable to include a jellifying agent to prevent the locally transparentizing liquid from spreading laterally or from penetrating vertically to such an extent that indicia appear on the other side of the sheet. In selecting a jellifying agent, an organic polymer should be chosen which has a solubility parameter differing from that of the transparentizing liquid by about 2 hildebrands. For example, for the isoalkanes used in Example 1, a suitable jellifying polymer is a styrene:isoprene:styrene block copolymer such as "Kraton" 1107, available from Shell Oil Company, or a polyisobutylene such as "Vistanex" L-140, available from Exxon. Where the transparentizing liquid is an alcohol, glycol, or water, carboxypolymethylene may be used as a jellifying polymer. Where the transparentizing liquid is an ester, cellulose acetate butyrate may be employed. The judicious use of jellifying resins may eliminate the need for a liquid barrier in the sheet material.

Numerous variations of the invention will be readily apparent to those reading the foregoing description. For example, games employing printed forms or score sheets (e.g., bridge, gin rummy, Yahtze, Clue, or Careers) can readily adapt the method of the invention to their particular requirements.

I claim:

1. A repeatedly reusable Bingo card comprising sheet material having an exposed layer that is microporous and comprises an organic polymer having interconnected microvoids, said exposed layer being permanently imprinted with at least one rectangle divided into individual smaller rectangles, at least five of said smaller rectangles being permanently imprinted with a number of one or two digits, each of said numbers being substantially darker in color than the background are within said smaller rectangles, said exposed layer being bonded to a liquid-impervious support sheet having a Hunter L value on the order of 30–55, substantially darker than the background are within said smaller rectangles but substantially lighter than said numbers, whereby when the area within a smaller rectangle is contacted with a colorless volatile liquid that is a non-solvent for said organic polymer and has a refractive index smaller to that of said polymer, the thus-contacted portions of the microporous layer become temporarily transparent, exposing the support sheet and forming indicia that are darker than said background area but lighter than said numbers, whereby it can be determined that the area within a given small rectangle has been marked but the number therein remains visible, volatilization of said liquid restoring said Bingo card to its original appearance.

2. The Bingo card of claim 1 wherein a microporous layer is bonded to both sides of the support layer.

3. The Bingo card of claim 2 wherein the support sheet comprises a polyethylene binder layer sandwiched between and uniting two colored liquid-absorbent paper layers, thereby providing the additional benefit of absorbing excess liquid applied to one of the microporous layers.

4. The Bingo card of claim 3 wherein the paper has a Hunter L value on the order of 30–55.

5. The Bingo card of claim 1 wherein the microporous layer has a cohesive value of at least 400 grams and consists essentially of particles held in pseudo-sintered juxtaposition by a thermoset binder.

6. The Bingo card of claim 1 wherein the microvoids contain a second organic polymer that jellifies in the presence of the colorless marking liquid, thereby limiting both lateral and vertical wicking of the marking liquid.

7. The Bingo card of claim 1 wherein a jellifying organic polymer other than the binder partially fills the microvoids, whereby, when there are applied to the exposed surface of said layer desired indicia of a marking liquid which has a refractive index approximately that of the particles, a solubility parameter differing from that of said polymer by about 2 hildebrands, is a non-solvent for said binder and is jellified by the jellifying polymer, the liquid not only penetrates the microvoids and is jellified by the jellifying polymer, thereby reducing the reflectivity of the layer in the vicinity of the liquid-penetrated microvoids to impart transparency and maintaining substantially constant dimensions of the indicia throughout the time that the layer is locally transparentized, but also is inhibited from excessive lateral and vertical wicking.

8. The Bingo card of claim 7 wherein there is present at least at the exposed surface of the imprinted microporous layer, an oleophobic fluorochemical that prevents the microvoids from being readily penetrated by oil and grease, so that said microvoids can be penetrated and transparentized only by polar liquids or liquids having a low surface tension, whereby potentially transparentizing contamination of the layer on the exposed surface of said imprinted microporous layer, caused by contact with oil and the like, can be removed by promptly placing the exposed surface in contact with an oil-absorbing sheet.

9. The Bingo card of claim 1 wherein the microporous layer comprises a first organic polymer having interconnected microvoids and is bonded to a liquid impervious support sheet having a substantially darker color than that of the microporous layer, whereby when there is applied locally a transparent colorless liquid that is a non-solvent for the first organic polymer and has a refractive index similar to that of the first organic polymer, the portions of the microporous layer contacted by the liquid become transparent and permit the support sheet to be seen and there is present at least at the exposed surface of the imprinted microvoid layer on one side an oleophobic fluorochemical that prevents the microvoids from being readily penetrated by oil and grease, the other side of the card being free from oleophobic fluorochemical whereby potentially transparentizing contamination of the layer on the exposed surface of said imprinted microporous layer, caused by contact with oil and the like, can be removed by promptly placing the exposed surface in contact with the oleophobic fluorochemical-free face of a similar Bingo card.

* * * * *

UNITED STATES PATENT AND TRADEMARK OFFICE

CERTIFICATE OF CORRECTION

PATENT NO. : 4,877,253

DATED : October 31, 1989

INVENTOR(S) : Robert P. Arens and F. Michael Megarry

It is certified that error appears in the above-identified patent and that said Letters Patent is hereby corrected as shown below:

Column 2, line 20, after "invention," insert -- there is provided a method of participating in a game of the type in which --

Column 3, line 67, "providing" should be -- provided --

Column 4, line 18, "0.4" should be -- 20.4 --

Column 6, claim 1, line 35, "are" should be -- area --
line 39, "are" should be -- area --

Signed and Sealed this

First Day of January, 1991

*Attest:*

HARRY F. MANBECK, JR.

*Attesting Officer*

*Commissioner of Patents and Trademarks*